United States Patent [19]

Heimsoth et al.

[11] Patent Number: 4,711,604

[45] Date of Patent: Dec. 8, 1987

[54] METHOD OF AND APPARATUS FOR INSTALLING AN ANCHOR MEMBER BELOW WATER LEVEL THROUGH A WALL INTO A SOIL FORMATION

[75] Inventors: Harald Heimsoth, Hamburg; Thomas Herbst, Wessling, both of Fed. Rep. of Germany

[73] Assignee: Dyckerhoff & Widmann Aktiengesellschaft

[21] Appl. No.: 915,318

[22] Filed: Oct. 3, 1986

[30] Foreign Application Priority Data

Oct. 3, 1985 [DE] Fed. Rep. of Germany ..... 3535319

[51] Int. Cl.[4] ..... E02D 29/06

[52] U.S. Cl. ..... 405/260; 405/228; 405/262; 175/9; 175/62

[58] Field of Search ..... 405/31, 228, 232, 260, 405/262; 175/9, 62

[56] References Cited

U.S. PATENT DOCUMENTS

| | | | |
|---|---|---|---|
| 1,267,129 | 5/1918 | Sewall | 405/228 |
| 2,865,180 | 12/1958 | Nielsen | 405/262 |
| 3,134,234 | 5/1964 | Parker et al. | 405/228 |
| 4,480,945 | 11/1984 | Schnabel | 405/262 |

FOREIGN PATENT DOCUMENTS 3122032 12/1982 Fed. Rep. of Germany .

*Primary Examiner*—David H. Corbin

*Attorney, Agent, or Firm*—Toren, McGeady & Associates

[57] ABSTRACT

For the installation of an anchor member at a location below a water level through a retaining wall into a soil formation for supporting the wall, a drill mount is pivotally mounted about a horizontal axis on a retaining member secured to the wall. The drill mount can be pivoted between a drilling position inclined downwardly toward the wall and an upwardly extending loading position where the drill mount is accessible above the water level. A cable line secured to the drill mount pivots it between the drilling and loading positions. A drilling machine is displaceable on a sliding carriage along the drill mount. A drilling tool inserted into the drilling machine is used to drill an opening through the wall. Subsequently the drilling tool is replaced by a borehole pipe and the pipe is driven through the wall opening into the soil formation. With the borehole pipe inserted, an anchor member can be placed into the pipe and by withdrawing the pipe and grouting around the anchor member at the same time, the installation of the anchor member can be completed.

21 Claims, 9 Drawing Figures

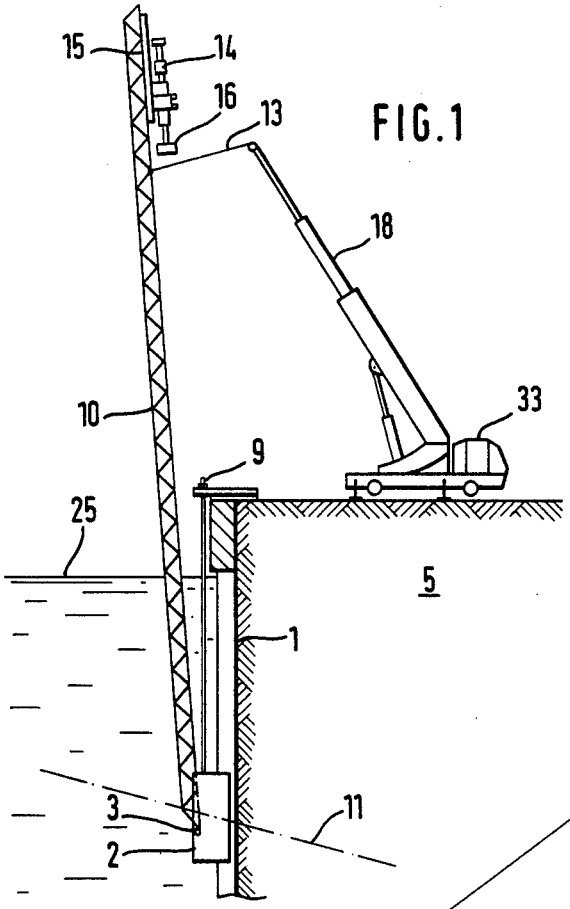
FIG.1
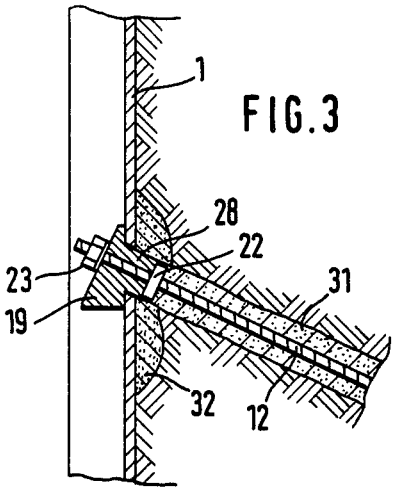
FIG.3
FIG.2
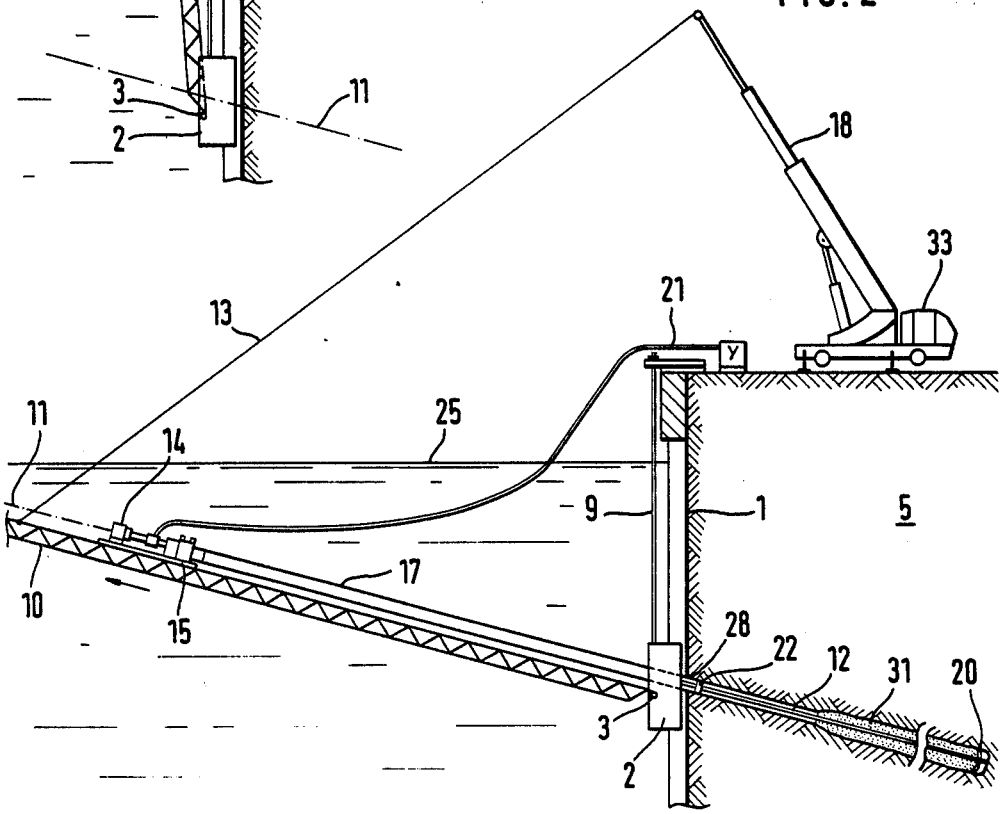

METHOD OF AND APPARATUS FOR INSTALLING AN ANCHOR MEMBER BELOW WATER LEVEL THROUGH A WALL INTO A SOIL FORMATION

CROSS-REFERENCE TO RELATED APPLICATION

A related application is to be filed at the same time with the present application in the names of Hans-Hinrich Stüben, Carl-Dietrich Bäthge, Thomas Herbst, Harald Heimsoth, and Günter Brüning based on the German patent application No. P 35 35 320.

BACKGROUND OF THE INVENTION

The present invention is directed to a method of and apparatus for installing an anchor, such as a rod, cable or pipe, below a water level through a wall into a soil formation where the wall may be formed of sheet piling, concrete, quay walls or the like. Initially, a retaining device is mounted on the wall and a drill mount is pivotally secured to the retaining device so that it can be pivoted between a drilling position located below the water level and a loading position where the mount is accessible above the water level. A submersible drilling machine is positioned on the drill mount for drilling below water. With the drill mount in the drilling position, the drilling machine can form an opening through the wall so that the anchor member can be inserted and anchored in place.

A known device of this type rams an anchor pile through sheet piling. Such a device includes a base plate arranged at the end of the drill mount and inclined in accordance with the desired direction, preferably at an angle of 45° to the drill mount and it is rigidly connected with the drill mount, note the German Patentschrift No. 31 22 032. This known device must be attached to the sheet piling by divers, with the drilling machine being operated from above the water surface by a control unit connected to the drilling machine by a hose connection. Initially, the sheet piling is drilled or cut through with a pipe-shaped drill, the drill remains in the sheet piling and serves as a guide during the ramming of the anchor pile through the sheet piling.

A disadvantage of this known method and apparatus is that a number of work steps can only be accomplished by divers. Moreover, the drill is expendible and the ramming of the anchor pile, apart from being guided by the short drill pipe, proceeds without any additional guidance and, as a result, is practically uncontrolled. If the anchor pile encounters resistance as it is being rammed, the sheet piling has to be redrilled for another anchor pile.

SUMMARY OF THE INVENTION

Therefore, it is the primary object of the present invention, to provide a method of the above-mentioned general type suitable for the installation of an anchor member and to afford apparatus for carrying out the method, so that the work to be performed underwater is reduced to a minimum or is completely avoided and the entire drilling apparatus can be recovered.

In accordance with the present invention, after the positioning and securing of the retaining device with the drill mount, the free end of the mount is lifted upwardly above the water level by pivoting it around a horizontal axis arranged in the retaining device. A drilling machine with a first drill tool for cutting through the sheet piling wall is placed on the upper end of the drill mount located above the water level. Subsequently, the mount is lowered to the drilling position and the sheet piling is drilled forming an opening through it. After withdrawing the first drill from the sheet piling the drill mount is lifted upwardly above the water level so that the drilling machine is accessible at a dry location and the drill is replaced with a borehole pipe. The mount has a sufficient length so that it can receive the full length of the borehole pipe. Again, the drill mount is lowered into the drilling position and the borehole pipe is driven through the opening in the sheet piling into the soil formation. Following the placement of an anchor member into the borehole pipe, the pipe is gradually withdrawn while the hollow space between the anchor member and the borehole wall is grouted with a settable material. The drill mount is raised above the water level to the loading position and the withdrawn borehole pipe can be removed. Further, the anchor member can be inserted at the same time with the borehole pipe so that it is in place during the formation of the borehole.

The retaining device can be supported on the sheet piling wall by hanger members, such as threaded rods, cables or the like, so that it can be adjusted and appropriately secured in a clamped fashion against the sheet piling. The drill mount pivotally secured to the retaining device can be raised and lowered by a cable line.

Finally, after the removal of the borehole pipe, a support pipe and possibly an anchor nut can be positioned on the drilling machine in the raised position and after lowering the mount into the drilling position the support plate and the anchor nut can be secured on the anchor member for completing the anchorage.

The advantage of the method of the present invention is that all of the loading and unloading operations on the drilling machine, the borehole pipe, the anchor member and the parts for completing the anchorage can be effected above the water level at a dry location when the drill mount is pivoted upwardly into the loading position. Subsequently, the mount can be lowered, in a simple manner, into the drilling position by means of the cable line. Further, the placement and the attachment of the retaining device on the sheet piling can be performed from a dry location by cable lines and other appropriate control devices. Since the overall length of the drill mount is greater than the length of the borehole pipe or of the anchor member, it is possible to install the borehole pipe and anchor member in a single unit and not by sections. Further, the anchor member can be inserted into the borehole pipe so that the two parts can be driven as a unit into the soil formation.

Apparatus particularly suited to performing the method of the present invention includes an adjustable retaining device which can be positioned at the desired location on the sheet piling or other wall and a drill mount can be pivotally attached to the retaining device so that it can be pivoted between a drilling position and a loading position. The drill mount includes guides for a drilling machine arranged to receive a drill and/or a borehole pipe. The drill mount is distinguished by the fact that it is dimensioned for the full length of the borehole pipe or the anchor member and is pivotally supported about a horizontal axis in the retaining device with the axis extending parallel to the sheet piling so that the mount can be lifted and lowered by a cable line whereby in the loading position the upper end of the mount is above the water level and the required operations can be carried out in the dry.

Appropriately, the retaining device can be suspended by tension hangers, such as threaded rods, cable or the like and can be raised and lowered from a dry location and can be adjusted relative to the sheet piling.

The pivot joint between the drill mount and the retaining device is detachable and a vertical guide rail can be provided so that the lower end of the drill mount can be lifted above the water surface and returned below the water surface to the location of the retaining device.

For a wedged attachment at the sheet piling, the retaining device can be provided with bottom wale pieces which are actuatable by hydraulic cylinder-piston units. It is also possible to secure the retaining device on the sheet piling using magnets or suction devices.

In a preferred arrangement, the retaining device includes guidance members adapted to the configuration of the sheet piling. Such guidance members facilitate locating the retaining device on the sheet piling and any torque developed during the drilling operation is absorbed and the retaining device is securely held against any horizontal displacement.

Moreover, the drill mount is supported at the retaining device so that it can be pivoted about an axis extending at right angles to the drilling axis. This pivot axis is such that it can pass at least approximately through the center of the opening formed in the sheet piling. The arrangement of this pivot joint in the region adjacent the opening in the sheet piling so that the axis of the joint passes through the center of the aperture and intersects the borehole axis, has the advantage that it is possible to drill through the same aperture or opening in the sheet piling at different horizontal angles. Such a variation in the angles is important if an obstruction is encountered during the drilling step. As a result, additional weakening of the sheet piling and delays in the working operations are avoided.

Finally, means for pivoting the drill mount around the pivot axis extending at right angles to the drilling axis and for the attachment of the mount at a specific location can be provided in the retension device. Appropriately, such means can be hydraulic cylinder-piston units.

A connecting strap can be arranged between the horizontal pivot axis and the other pivot axis extending at right angles to the drilling axis. It is also possible to combine the two pivot axes in a single spherical joint. Finally, the mount can be supported at the retaining device by a universal joint with the pivot axes permitting horizontal pivot movement extending through the center of the opening formed in the sheet piling.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the drawing:

FIG. 1 is a schematic vertically extending sectional view through a sheet piling wall retaining a soil formation and illustrating a device embodying the present invention with the device located in the raised loading position;

FIG. 2 is a vertical sectional view similar to FIG. 1 with the mount lowered to the drilling position;

FIG. 3 is an enlarged sectional view of a portion of the sheet piling with the anchor member in its final anchored condition;

DETAILED DESCRIPTION OF THE INVENTION

Figure 4:
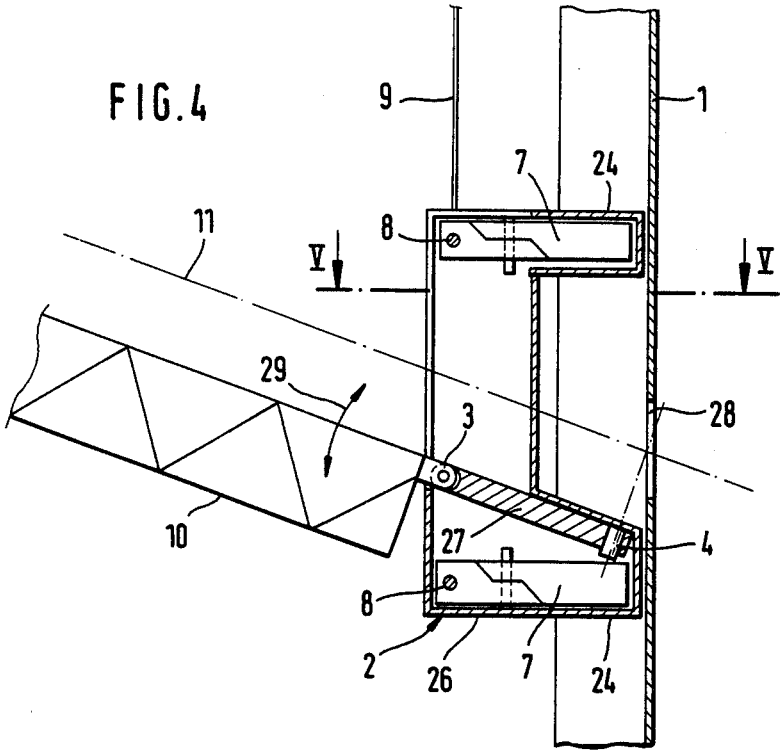
FIG. 4 is an enlarged vertical section through the retaining device adjacent the sheet piling and taken along the line IV—IV in FIG. 5.

FIGS. 1 and 2 illustrate the manner in which an anchor member can be placed in accordance with the present invention and also indicates the apparatus for carrying out the method. The method and apparatus are used for the subsequent securement of a sheet piling wall by a grouted anchor with a downwardly inclined axis 11 relative to the soil formation 5, so that a grouted anchor member can be placed through the wall 1 into the soil formation 5 for holding the sheet piling wall acting as a retainer wall for the soil formation. Since the anchor member for its entire length is located below the water level 25 on the opposite side of the wall 1 from the soil formation 5, all of the required working operation must be carried out underwater.

Initially, a retaining member 2 is positioned on the sheet piling wall 1 on the opposite side from the soil formation 5. A drill mount 10 is pivotally supported on the retaining member about a joint 3 with a horizontal axis extending parallel to the surface of the sheet piling 1 with the axis located in the retaining member. The arrangement of the retaining member will be described in greater detail later with the help of FIGS. 4 and 5. The length of the drill mount extending upwardly from the retaining member in FIG. 1 and generally horizontally outwardly from the retaining member in FIG. 2 is such that it can accommodate the full length of a borehole pipe 17 needed for forming a bore in the soil formation 5 and an anchor member 12 to be positioned in the borehole formed by the pipe.

As can be appreciated from FIG. 1, the retaining member 2 with the drill mount 10 is lowered by tension hangers or tie rods 9, such as threaded rods, from the surface of the soil formation 5 to the desired depth and is attached to the sheet piling 1. The upper end of the mount 10 as viewed in FIG. 1 is supported by a cable line 13 connected to the telescopic boom 18 of a mobile crane 33. I this loading position of the drill mount 10, a drilling machine 14 can be installed at a dry location. The drilling machine 14 is displaceable along the length of the drill mount 10 by means of sliding carriage 15.

The drilling machine 14 is designed in a known manner and includes a drilling head and a drive motor. A rotary swivel is located behind the drilling head with linkages passing through the head. The rotary swivel can be displaced along the drill mount 10 independently of the drilling head.

To commence the method, a drill bit 16 is attached to the drilling machine 14 for drilling or cutting a hole in the sheet piling. After the drill mount 10 is lowered into the drilling position, as shown in FIG. 2, by the cable line 13, the drill bit 16 is aligned with the axis 11 on the anchor member and, accordingly, axis 11 also forms the drilling axis. Next, the drilling machine 14 mounting the drill bit 16 is moved by a chain drive along the mount 10 toward the sheet piling until the drill bit is located at the sheet piling and can drill a hole through it. After the opening through the sheet piling is formed, the drilling machine and the drill bit is moved along the mount to the initial position at the outer end of the mount and the mount is pivoted about the horizontal axis 3 upwardly so that the drill bit 16 can be removed at a dry location above the water level 25. In the next method step, a borehole pipe 17 is placed for its full length upon the drill mount 10 and is aligned with and connected to the drilling machine 14. Again the mount is lowered from the loading position in FIG. 1 to the drilling position in FIG. 2 and the borehole pipe 17 is driven by means of the drilling machine 14 for the desired depth into the soil formation passing through the opening 28 previously cut through the sheet piling 1. After the borehole has been produced in the soil formation 5, the drilling machine is separated from the borehole pipe and it is moved along the drill mount into its initial position and the mount 10 is pivoted upwardly into the loading position.

In the next method step, an anchor member 12, such as an anchor rod, is placed and aligned on the mount 10. At its bottom end in the loading position, the anchor member has a claw arrangement 20, note FIG. 2. In addition, an annular sealing disc 22 is secured on the anchor member 12 and forms a seal for the hollow annular space between the anchor member and the inner surface of the borehole pipe 17. A grouting line 21 is located along the anchor member 12 and passes through the sealing disc 22. The anchor member 12 is supported by the linkage of the rotary swivel. After the mount 10 is lowered into the drilling position, the anchor member 12 is inserted into the borehole pipe 17 by the drilling machine 14 until it reaches the desired position.

Since the length of the drill mount 10 is greater than the length of the anchor member 12, the complete anchor member can be placed into the previously driven borehole pipe 17 and it can be threaded into the soil formation 5 along with the borehole pipe.

With the anchor member 12 in the inserted position, the head of the drilling machine 14 is recoupled to the borehole pipe 17 so the pipe can be withdrawn out of the soil formation 5. This arrangement is displayed in FIG. 2. In carrying out the method, initially, the borehole pipe 17 is pulled outwardly by a short distance, while the rotary swivel retains the anchor member 12 in a stationary position. By activating the claw device 20, the anchor member is secured within the soil formation. Subsequently, by continuously withdrawing the borehole pipe 17 and continuously grouting the hollow annular space between the anchor member 12 and the borehole formed by the pipe, the grouting operation continues through the grouting line 21 until the grout reaches the sealing disc 22. As a result, a grouted member 31 is formed within the soil formation 5. When the drilling machine 14 along with the borehole pipe 17 has reached the initial position, the grouting line 21 at the anchor member 12 is detached. The drill mount 10 is pivoted removed from the mount.

A crosshead or support member 19, in the form of a finished concrete part, is attached to the head of the drilling machine and it is aligned and adjusted on the mount. After the mount is lowered into the drilling position, the crosshead 19 is moved by the drilling machine toward the sheet piling 1, that is, toward the end of the anchor member and it is placed on the end of the anchor member. The crosshead 19 then extends by a certain amount into the opening 28 formed in the sheet piling, note FIG. 3.

After releasing the connection with the crosshead 19, the drilling machine 14 is returned along the mount into its original position. Subsequently, an anchor nut 23 is placed on the anchor member and is screwed onto it. This step can be carried out without requiring a diver. If a hollow space remains between the sheet piling 1 and the grouted anchor member inwardly of the sheet piling, the space can be grouted with the grout material 32 through apertures in the crosshead 19 and the anchor head is sealed in this manner.

Figure 9:
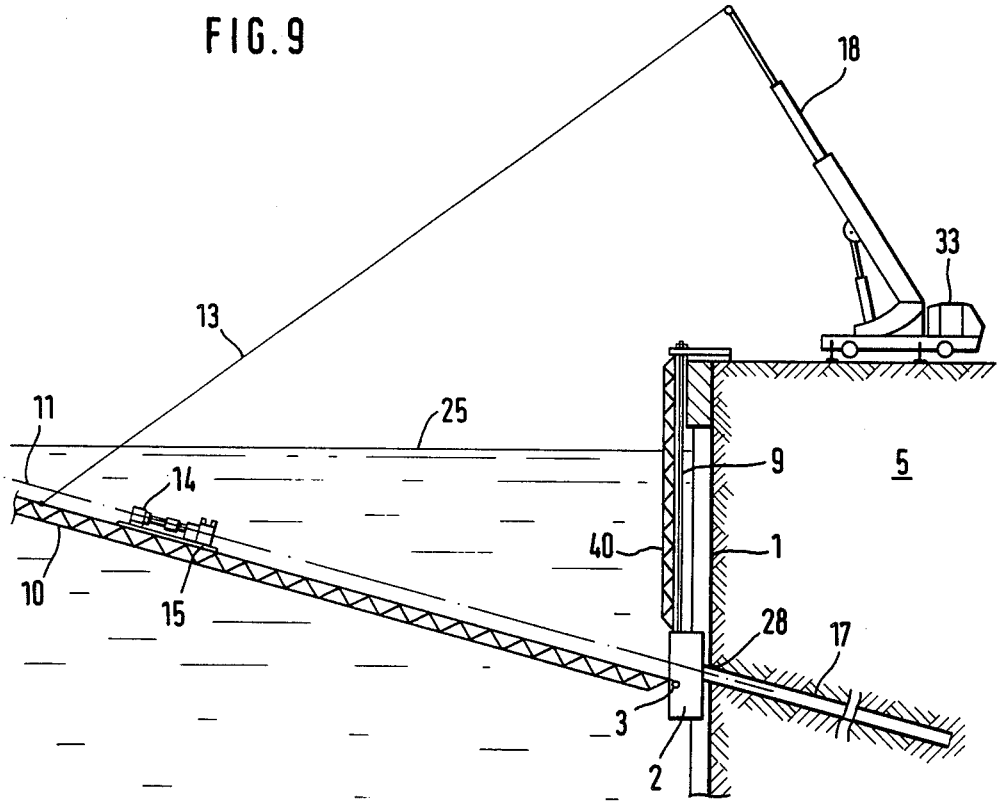
FIG. 9 is a vertical sectional view similar to FIGS. 1 and 2 showing the sheet piling and displaying another embodiment of the present invention.

If for any reason the mount has to be lifted above the water level for its entire length, it is possible to provide guide rails 40, note FIG. 9, extending upwardly from the retaining member 2 so that the mount can be moved upwardly along the guide rails after the pivot joint 3 is disconnected.

Figure 5:
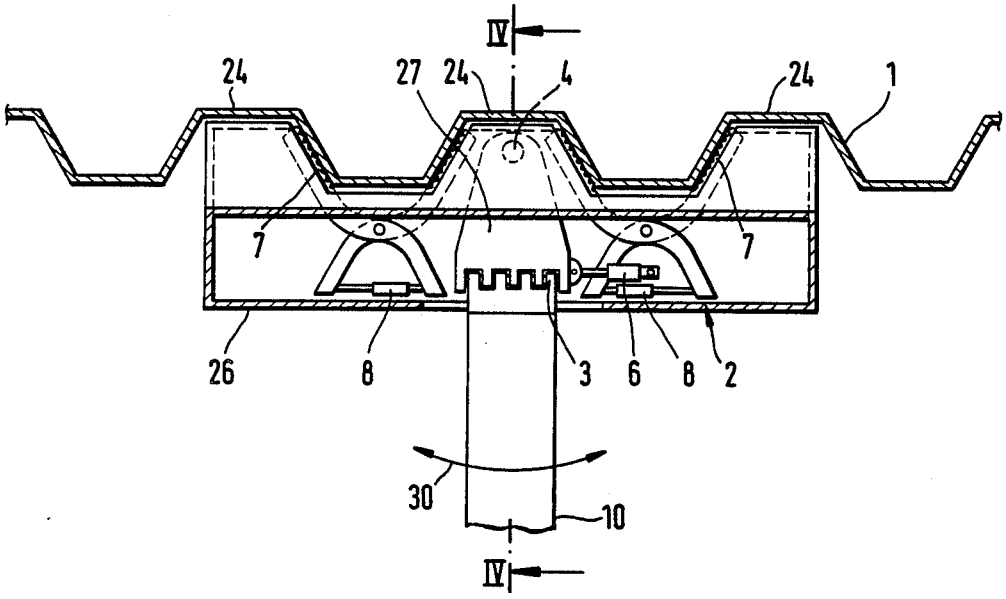
FIG. 5 is a horizontal sectional view through the retaining device taken along the line V—V in FIG. 4.

One embodiment of the retaining member 2 is shown in detail in FIGS. 4 and 5. The retaining member 2 is made up of a housing 26 at least partially open toward the sheet piling 1 and has four bottom wale pieces or tongues 7 actuable by hydraulic cylinder-piston units 8. The outer ends of the bottom wale pieces 7 are adapted to the configuration of the individual sheet piling sections and are roughened or provided with teeth to afford good contact with the sheet piling 1. The bottom wale pieces 7 serve only for the attachment of the retaining member 2 to the sheet piling 1. The weight of the wale pieces and of the mount 10 is supported by the hangers 9 so that an appropriate anchorage is provided at the surface of the soil formation five.

The retaining member 2 has guidance members 24 conforming to the configuration of the sheet piling on the side of the retaining member facing the sheet piling for facilitating the centering of the retaining member and assisting in the transmittal of torque, generated during the drilling operation, to the sheet piling 1 or for relieving the load on the bottom wale pieces 7.

Mount 10 is connected with a bracket 27 by the joint 3 having a horizontal axis extending parallel to the sheet piling 1 and the bracket is supported on the housing 26 by another joint 4 with a generally upwardly extending axis located in a vertical plane at right angles to the drilling axis 11. Accordingly, mount 10 can be pivoted in the vertical direction, note arrow 29 in FIG. 5, about the joint 3 and in the horizontal direction, note arrow 30 in FIG. 5, about the joint 4. The pivotal movement of the drill mount 10 in the upward direction as shown by the arrow 29 is effected by the cable line 13. Pivotal movement in the horizontal direction as indicated by the arrow 30 is effected by a cylinder-piston unit 6 arranged at the bracket 27 and abutting against the housing 26 of the retaining member 2.

As shown in FIG. 4, the extension of the axis of the joint 4 passes through the center of the opening 28 formed in the sheet piling 1 and intersects in the opening with the drilling axis 11. With this arrangement it is possible to produce several bores with different horizontal angles through the opening 28, for instance if the drilling operation is blocked and a new borehole must be formed.

Figure 6:
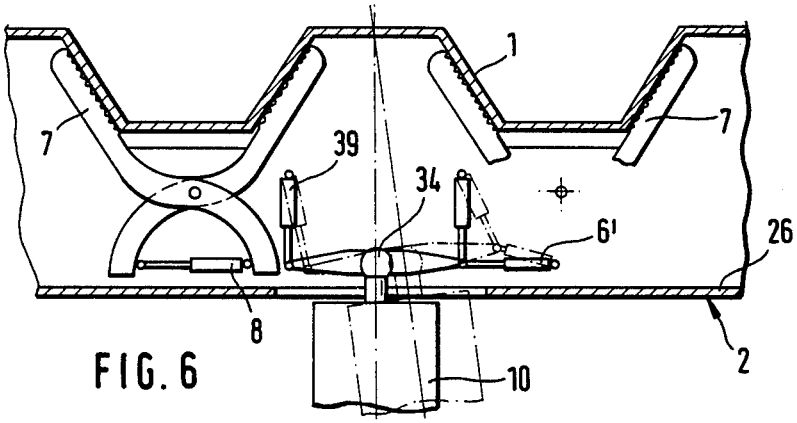
FIG. 6 is a horizontal sectional view, similar to FIG. 5, taken through the retention device but illustrating another arrangement of the pivot joints for the drill mount.
Figure 7:
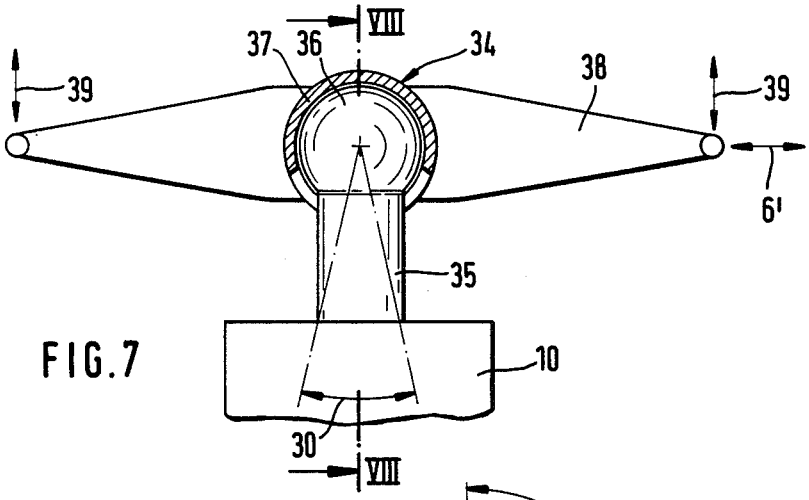
FIG. 7 is an enlarged detail view of a portion of the device shown in FIG. 6.
Figure 8:
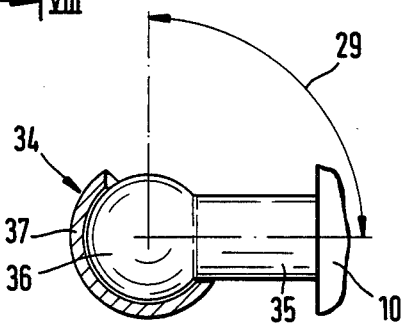
FIG. 8 is a sectional view taken along the line XIII—XIII in FIG. 7.

Another embodiment of the articulated support of the mount 10 at the retaining member 2 is illustrated in FIGS. 6–8. In this embodiment the two pivotal movements of the mount 10 about the vertical and horizontal axes through the joints 3 and 4 are combined in a single ball joint 34. The ball joint 34 is made up of a ball 36 secured on a pin 35 of the mount and the ball is rotatable in a socket 37 with the interior of the socket being formed partially as a hollow sphere. The socket 37 is supported on a guide beam 38 connected at both ends in an articulated manner with cylinder-piston units 39. In turn, the cylinder-piston units 39 are attached to the housing 26 of the retaining member 2. The cylinder-piston units serve for the compression support of the drill mount while the pivotal movement in the horizontal direction is effected by a cylinder-piston unit 6'. The possible movement of the mount in the vertical and horizontal directions are indicated by the arrows 29, note FIG. 8, and 30, note FIG. 7.

While specific embodiments of the invention have been shown and described in detail to illustrate the application of the inventive principles, it will be understood that the invention may be embodied otherwise without departing from such principles.

We claim:

1. Method of installing an anchor member, such as a rod, cable or pipe, into a soil formation retained by a wall where the installation can be effected through the wall below a water level, comprising the steps of mounting a retaining member on the wall at the location where the anchor member is to be installed through the wall into the soil formation, positioning an elongated drill mount having a first end and a second end on the retaining member, supporting a drilling member on the drill mount, drilling an opening through the wall by means of the drilling machine, inserting the anchor member through the opening in the wall and into the soil formation, and anchoring the anchor member within the soil formation, wherein the improvement comprises, after adjusting and attaching the retaining device to the wall, supporting the first end of the drill mount on the retaining device for pivotal movement about a horizontal axis, lifting the drill mount adjacent the second end thereof above the water level into a loading position, pivoting the drill mount about the horizontal axis at the first end thereof, arranging the drilling member adjacent the second end of said drill mount and placing a first drilling tool in the drilling member in the loading position, lowering the drill mount into a drilling position inclined downwardly toward the wall, moving the drilling member toward the wall and drilling the opening through the wall using the drilling member and the first drilling tool, withdrawing the drilling member away from the wall after the opening has been formed and lifting the drill mount upwardly to the loading position so that the second end of the drill mount is located above the water level, replacing the first drilling tool above the water level with a borehole pipe and attaching the borehole pipe to the drilling member, lowering the drill mount from the loading position into the drilling position and driving the borehole pipe through the opening in the wall and for the desired depth into the soil formation and forming a borehole within the soil formation, inserting the anchor member for the desired depth into the borehole pipe, and after the insertion of the anchor member withdrawing the borehole pipe and at the same time injecting a settable grout material into the space between the borehole and the anchor member, and lifting the drilling mount into the loading position for removing the borehole pipe.

2. Method, as set forth in claim 1, including the step of introducing the anchor member into the borehole pipe before drilling the borehole pipe into the soil formation.

3. Method, as set forth in claim 1, including hanging the retaining device from a location above the water level and supporting the retaining device from the location above the water level.

4. Method, as set forth in claim 1, including the step of securing the retaining member in a wedged manner on wall.

5. Method, as set forth in claim 1, including the step of lifting and lowering the drill mount by a cable line.

6. Method, as set forth in claim 1, including the step of, after the removal of the borehole pipe from the drill mount, placing a cross head on the drill mount and securing the cross head to the drilling machine and with the drill mount in the drilling position placing the cross head in the opening formed in the wall and securing an anchoring element on the anchor member in contact with the cross head for forming an anchorage for the anchor member.

7. Apparatus for installing an anchor member, such as a rod, cable or pipe, into a soil formation retained by a wall where the installation can be effected through the wall below a water level, comprising a retaining member arranged to be mounted on the wall at a location below the water level where the anchor member is to be installed, said retaining member having a horizontal axis, an elongated drill mount having a first end pivotally mounted on the horizontal axis of the retaining member and a second end with said drill mount being pivotally displaceable about the horizontal axis between a lower drilling position and an upper loading position where the drill mount extends above the water level so that the access to the drill mount is available above the water level, a drilling machine mountable on said drill mount, a drilling tool insertable into said drilling machine for drilling a hole through the wall in the drilling position of the drill mount, a borehole pipe being insertable in said drilling machine for driving the borehole pipe through the opening in the well for a desired depth into the soil formation, and means for moving the drill mount between the loading and drilling positions.

8. Apparatus, as set forth in claim 7, wherein generally vertically extending hangers support the retaining member from a location above the water level and the retaining member is movable upwardly and downwardly by means of said hangers relative to the surface of the wall.

9. Apparatus, as set forth in claim 7, wherein the pivotal connection of said drill mount to said horizontal axis is detachable, and means for lifting the first end of said drill mount upwardly above the water surface and for lowering the drill mount below the water surface for connection to the horizontal axis.

10. Apparatus, as set forth in claim 7, wherein a plurality of bottom wale pieces are provided on the lower portion of said retaining device for effecting a wedgetype attachment of said retaining member with the sheet piling.

11. Apparatus, as set forth in claim 10, wherein hydraulic cylinder-piston units are provided for actuating said bottom wale pieces.

12. Apparatus, as set forth in claim 7, wherein magnets are provided for securing said retaining member to said wall.

13. Apparatus, as set forth in claim 7, wherein suction means are provided for securing said retaining member to said wall.

14. Apparatus, as set forth in claim 7, wherein said retaining device includes guidance members shaped to the configuration of the wall.

15. Apparatus, as set forth in claim 7, wherein said retaining member includes a generally upwardly extending joint having an axis extending perpendicularly to the drilling axis of the drilling machine on said drill mount, and said drill mount being pivotally supported for pivotal movement in the horizontal direction about the upwardly extending joint.

16. Apparatus, as set forth in claim 15, wherein the axis of the upwardly extending joint extends at least approximately through the center of the opening formed in the wall.

17. Apparatus, as set forth in claim 16, wherein means are located in said retaining device for pivoting said drill mount about the upwardly extending axis perpendicular to the drilling axis and for securing said drill mount in specific positions.

18. Apparatus, as set forth in claim 17, wherein said means comprises a hydraulic cylinder-piston unit for pivoting said drill mount about the upwardly extending axis and for securing the drill mount.

19. Apparatus, as set forth in claim 18, wherein a connecting bracket is positioned between the horizontal axis and the upwardly extending axis.

20. Apparatus, as set forth in claim 18, wherein a ball joint mounted in said retaining member combines the horizontal axis and the upwardly extending axis for effecting the pivotal movement of said drill mount.

21. Apparatus, as set forth in claim 18, wherein a universal joint is mounted in said retaining member and includes the horizontal axis and the upwardly extending axis for the pivotal movement of said drill mount relative to said retaining member.

* * * * *